US010460897B2

(12) United States Patent
Lee

(10) Patent No.: US 10,460,897 B2
(45) Date of Patent: Oct. 29, 2019

(54) MAGNETIC TRIP DEVICE FOR CIRCUIT BREAKER

(71) Applicant: LSIS CO., LTD., Anyang-si, Gyeonggi-do (KR)

(72) Inventor: Kyuho Lee, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 93 days.

(21) Appl. No.: 15/855,619

(22) Filed: Dec. 27, 2017

(65) Prior Publication Data

US 2018/0190463 A1 Jul. 5, 2018

(30) Foreign Application Priority Data

Jan. 5, 2017 (KR) ..... 10-2017-0001986

(51) Int. Cl.
*H01H 9/00* (2006.01)
*H01H 71/24* (2006.01)
(Continued)

(52) U.S. Cl.
CPC ..... *H01H 71/2463* (2013.01); *H01H 21/36* (2013.01); *H01H 71/2472* (2013.01);
(Continued)

(58) Field of Classification Search
CPC .. H01H 3/22; H01H 9/02; H01H 9/04; H01H 13/04; H01H 71/12; H01R 9/26
(Continued)

(56) References Cited

U.S. PATENT DOCUMENTS 3,182,151 A * 5/1965 Coughlin ..... H01H 9/04 335/15
3,335,375 A * 8/1967 Fujita ..... H01H 50/32 335/18
(Continued)

FOREIGN PATENT DOCUMENTS

CN 205789785 U 12/2016
EP 1975965 A2 10/2008
(Continued)

OTHER PUBLICATIONS

Korean Office Action for related Korean Application No. 10-2017-0001986; action dated Dec. 7, 2017; (5 pages).
(Continued)

*Primary Examiner* — Shawki S Ismail
*Assistant Examiner* — Lisa N Homza
(74) *Attorney, Agent, or Firm* — K&L Gates LLP

(57) ABSTRACT

The present disclosure relates to a magnetic trip device for a circuit breaker capable of maintaining fault information indication until a user removes the cause of an accident subsequent to a trip operation and resets the magnetic trip device. The device comprises an actuator coil part having a plunger; an output plate; a micro switch outputting an electrical signal indicating a state of the circuit breaker; a switch driving lever mechanism rotating to press and releasing the micro switch; a driving lever bias spring elastically biasing the switch driving lever mechanism to rotate; an automatic reset mechanism pressing the plunger to a retracted position; and a driving lever latch rotating to a restraining position for preventing the switch driving lever mechanism from rotating to a first position, and a release position allowing the switch driving lever mechanism-to rotate to the first position.

11 Claims, 9 Drawing Sheets

(51) Int. Cl.
*H01H 89/00* (2006.01)
*H01H 71/52* (2006.01)
*H01H 21/36* (2006.01)

(52) U.S. Cl.
CPC ..... *H01H 71/52* (2013.01); *H01H 89/00* (2013.01); *H01H 2235/01* (2013.01)

(58) Field of Classification Search
USPC ..... 335/174
See application file for complete search history.

(56) References Cited

U.S. PATENT DOCUMENTS 3,401,363 A * 9/1968 Vyskocil ..... H01H 71/04 335/10
3,443,258 A * 5/1969 Dunham ..... H01H 71/04 335/13
3,596,218 A * 7/1971 Layton ..... H01H 71/04 200/308
3,596,219 A * 7/1971 Erickson ..... H01H 71/04 335/17
3,622,923 A * 11/1971 Shaffer ..... H01H 71/2472 335/17
3,683,350 A * 8/1972 Shedenheim ..... H01H 73/14 335/10
3,742,402 A * 6/1973 Nicol ..... H01H 71/465 335/13
3,970,975 A * 7/1976 Gryctko ..... H01H 71/04 335/18
3,973,230 A * 8/1976 Ciarcia ..... H01H 71/462 335/13
4,001,739 A 1/1977 Powell et al.
4,037,185 A * 7/1977 Klein ..... H01H 71/04 335/17
4,042,896 A * 8/1977 Powell ..... H01H 71/70 335/17
4,056,816 A * 11/1977 Guim ..... H01H 71/46 335/17
4,121,077 A * 10/1978 Mrenna ..... H01H 71/04 200/308
4,124,831 A * 11/1978 Kasahara ..... H01H 71/142 335/16
4,166,989 A * 9/1979 Castonguay ..... H01H 71/04 335/13
4,242,551 A * 12/1980 Sorenson ..... H01H 23/025 200/302.3
4,250,476 A * 2/1981 Evans ..... H01H 9/0066 200/308
4,301,342 A * 11/1981 Castonguay ..... H01H 71/04 200/308
4,301,433 A * 11/1981 Castonguay ..... H01H 71/46 335/13
4,308,511 A * 12/1981 Borona ..... H01H 89/06 307/38
4,347,488 A * 8/1982 Mune ..... H01H 71/1027 335/8
4,382,270 A * 5/1983 Davidson ..... H01H 71/04 335/17
4,417,222 A * 11/1983 Schmitt ..... H01H 1/2066 335/23
4,491,709 A * 1/1985 Chabot ..... H01H 3/3021 200/288
4,506,246 A * 3/1985 Wong ..... H01H 3/30 335/160
4,554,524 A * 11/1985 Radus ..... H01H 73/14 335/17
4,623,859 A * 11/1986 Erickson ..... H01H 3/38 335/14
4,623,861 A * 11/1986 Krasij ..... H01H 71/54 200/303
4,652,867 A * 3/1987 Masot ..... H01H 71/04 340/638
4,760,384 A * 7/1988 Vila-Masot ..... H01H 71/04 335/17
4,768,025 A * 8/1988 Vila-Masot ..... H01H 71/04 335/17
4,801,906 A * 1/1989 Morris ..... H01H 71/465 335/13
4,900,275 A * 2/1990 Fasano ..... H02B 1/052 439/716
4,951,021 A * 8/1990 Theisen ..... H01H 71/1054 335/140
5,003,139 A * 3/1991 Edds ..... H01H 71/0214 200/308
5,041,805 A * 8/1991 Ohishi ..... H01H 71/04 335/14
5,089,796 A * 2/1992 Glennon ..... H01H 83/22 335/172
5,095,293 A * 3/1992 Patel ..... H01H 1/0015 335/17
5,113,043 A * 5/1992 Morris ..... H01H 9/282 200/43.01
5,140,115 A * 8/1992 Morris ..... H01H 9/16 200/308
5,192,941 A * 3/1993 Fishovitz ..... H01H 71/46 335/17
5,192,942 A 3/1993 Fishovitz et al.
5,223,681 A * 6/1993 Buehler ..... H01H 71/504 218/22
5,252,933 A * 10/1993 Kamino ..... H01H 89/08 335/172
5,258,732 A * 11/1993 Marquardt ..... H01H 71/02 335/132
5,369,385 A * 11/1994 Schulte ..... H01H 73/52 335/167
5,424,701 A * 6/1995 Castonguay ..... H01H 3/30 200/400
5,453,724 A * 9/1995 Seymour ..... H01H 71/322 335/172
5,486,660 A * 1/1996 Fasano ..... H01H 71/1054 200/303
5,541,800 A * 7/1996 Misencik ..... H01H 73/14 335/18
5,607,047 A * 3/1997 Leet ..... H01H 11/0018 200/303
5,657,002 A * 8/1997 Ogden ..... H01H 85/30 335/14
5,701,110 A * 12/1997 Scheel ..... H01H 1/5805 335/132
5,714,940 A * 2/1998 Fishovitz ..... H01H 71/46 200/400
5,723,832 A * 3/1998 Hall ..... H01H 9/286 200/43.16
5,773,778 A * 6/1998 Arnold ..... H01H 71/50 218/153
5,794,759 A * 8/1998 Butts ..... H01H 9/287 200/43.01
5,831,500 A * 11/1998 Turner ..... H01H 71/04 335/17
5,861,784 A * 1/1999 Heise ..... H01H 83/20 200/400
5,907,140 A * 5/1999 Smith ..... H01H 9/287 200/304
5,917,391 A * 6/1999 Mahaney ..... H01H 13/20 335/17
5,920,451 A * 7/1999 Fasano ..... H01H 73/14 335/18
5,923,261 A * 7/1999 Castonguay ..... H01H 71/465 200/400
5,936,535 A * 8/1999 Rosen ..... H01H 71/465 335/17
5,982,258 A 11/1999 Baginski et al.
6,031,438 A 2/2000 Runyan
6,062,914 A * 5/2000 Fasano ..... H01H 71/08 361/634
6,104,265 A * 8/2000 Maloney ..... H01H 71/462 200/308

(56) References Cited

U.S. PATENT DOCUMENTS 6,104,266 A * 8/2000 Tilghman ..... H01H 71/04 335/17
6,107,902 A * 8/2000 Zhang ..... H01H 71/04 200/308
6,130,390 A * 10/2000 Castonguay ..... H01H 71/04 200/308
6,137,385 A * 10/2000 Conway ..... H01H 71/465 335/132
6,140,897 A * 10/2000 Mueller ..... H01H 71/0228 200/43.01
6,144,271 A * 11/2000 Mueller ..... H01H 71/0228 335/167
6,222,433 B1 * 4/2001 Ramakrishnan ..... H01H 1/2058 200/308
6,246,304 B1 * 6/2001 Gasper ..... H01H 71/04 335/17
6,284,991 B1 * 9/2001 Fasano ..... H01H 71/0264 200/296
6,528,744 B2 * 3/2003 Bremner ..... H01H 3/20 200/334
6,600,396 B1 * 7/2003 Rodriguez ..... H01H 71/0228 335/132
6,639,492 B1 10/2003 Hall et al.
6,803,535 B1 * 10/2004 Whipple ..... H01H 71/04 200/308
6,864,450 B1 3/2005 Chen et al.
6,897,747 B2 * 5/2005 Brandon ..... H01H 71/524 335/17
7,034,644 B2 * 4/2006 Moldovan ..... H01H 71/04 335/17
7,411,766 B1 * 8/2008 Huang ..... H01H 71/04 335/13
7,488,913 B1 * 2/2009 Durham ..... H02B 1/052 200/400
7,592,888 B2 * 9/2009 Colsch ..... H01H 71/74 335/176
7,598,828 B1 * 10/2009 Weeks ..... H01H 83/04 335/18
7,649,433 B2 * 1/2010 Eley ..... H01H 71/04 200/308
8,766,749 B2 * 7/2014 Ganley ..... H01H 71/125 335/172
8,836,453 B2 * 9/2014 Yang ..... H01H 9/20 335/167
8,963,662 B2 * 2/2015 Asokan ..... H01H 33/182 335/147
8,973,519 B2 * 3/2015 Bindics ..... H01H 9/16 116/285
9,029,727 B2 * 5/2015 Puhalla ..... H01H 33/20 218/148
9,230,757 B2 * 1/2016 Rego ..... H01H 23/04
9,966,210 B1 * 5/2018 Fasano ..... H01H 33/42
2002/0158724 A1 * 10/2002 Wellner ..... H01H 71/02 335/16
2002/0158725 A1 * 10/2002 Nerstrom ..... H01H 71/04 335/17
2002/0158726 A1 * 10/2002 Wellner ..... H01H 71/04 335/18
2003/0038692 A1 * 2/2003 Schmalz ..... H02H 1/06 335/35
2004/0051605 A1 * 3/2004 Fasano ..... H01H 9/443 335/35
2004/0070474 A1 * 4/2004 Wu ..... H01H 83/04 335/18
2004/0085167 A1 * 5/2004 McCormick ..... H01H 71/46 335/16
2004/0145846 A1 * 7/2004 Fasano ..... H01H 71/123 361/102
2004/0196123 A1 * 10/2004 Simms ..... H01H 1/54 335/6
2005/0046525 A1 * 3/2005 Tongo ..... H01H 73/14 335/17
2005/0046526 A1 * 3/2005 Lipsey, II ..... H01H 73/14 335/17
2005/0140477 A1 * 6/2005 Germain ..... H01H 83/04 335/18
2005/0212628 A1 * 9/2005 Castonguay ..... H01H 89/08 335/20
2005/0212629 A1 * 9/2005 Williams ..... H01H 89/08 335/20
2005/0258921 A1 * 11/2005 Puskar ..... H01H 71/0228 335/17
2006/0071742 A1 * 4/2006 Castonguay ..... H01H 89/08 335/20
2006/0125583 A1 * 6/2006 Mills ..... H01H 71/123 335/172
2006/0202785 A1 * 9/2006 Whipple ..... H01H 71/04 335/17
2007/0085638 A1 * 4/2007 Zindler ..... H01H 71/04 335/132
2007/0132530 A1 * 6/2007 Wang ..... H01H 83/04 335/6
2007/0188276 A1 * 8/2007 Shi ..... H01H 83/04 335/6
2007/0194869 A1 * 8/2007 Titus ..... H01H 71/04 335/172
2007/0200652 A1 * 8/2007 Gibson ..... H01H 71/04 335/17
2007/0229202 A1 * 10/2007 Gao ..... H01H 9/161 335/18
2008/0012664 A1 * 1/2008 DeBoer ..... H01H 51/2209 335/14
2008/0042787 A1 * 2/2008 McCoy ..... H01H 71/04 335/186
2008/0247100 A1 * 10/2008 Fasano ..... H01H 83/02 361/45
2009/0256660 A1 * 10/2009 Babu ..... H01H 71/04 335/17
2010/0026426 A1 * 2/2010 Mortun ..... H01H 73/44 335/18
2010/0073113 A1 * 3/2010 Yang ..... H01H 71/123 335/15
2010/0226053 A1 * 9/2010 Kamor ..... H01H 83/04 361/42
2011/0141633 A1 * 6/2011 Fasano ..... H01H 83/02 361/42
2011/0181379 A1 * 7/2011 Sohn ..... H01H 71/04 335/17
2012/0037598 A1 * 2/2012 Fasano ..... H01H 9/36 218/22
2012/0085627 A1 * 4/2012 Yang ..... H01H 71/46 200/43.16
2012/0168295 A1 * 7/2012 Lin ..... H01H 73/52 200/560
2012/0262255 A1 * 10/2012 Fasano ..... H01H 71/2409 335/7
2013/0088310 A1 * 4/2013 Yang ..... H01H 9/20 335/14
2013/0180956 A1 * 7/2013 Fasano ..... H01H 33/20 218/148
2013/0241677 A1 * 9/2013 Padro ..... H01H 83/144 335/18
2013/0241678 A1 * 9/2013 Bonasia ..... H01H 83/04 335/18
2013/0278361 A1 * 10/2013 Weeks ..... H05K 5/02 335/6
2014/0062623 A1 * 3/2014 Fasano ..... H01H 71/2463 335/16
2014/0076700 A1 * 3/2014 Lin ..... H01H 9/48 200/304
2014/0083828 A1 * 3/2014 Maloney ..... H01H 11/00 200/304
2014/0139302 A1 * 5/2014 Rubbo ..... H01H 71/04 335/17
2014/0251959 A1 * 9/2014 Fasano ..... H01H 9/30 218/155
2015/0035629 A1 * 2/2015 Thomas ..... H01H 71/04 335/38

(56) References Cited

U.S. PATENT DOCUMENTS

| | | | | |
|---|---|---|---|---|
| 2015/0070114 | A1* | 3/2015 | Fasano | H01H 71/32 335/21 |
| 2015/0200533 | A1* | 7/2015 | Simonin | H02H 3/05 335/17 |
| 2016/0049263 | A1* | 2/2016 | Maloney | H01H 3/04 335/21 |
| 2016/0049274 | A1* | 2/2016 | Maloney | H01H 71/025 335/21 |
| 2016/0135313 | A1* | 5/2016 | Freeman | H01H 3/02 |
| 2016/0163488 | A1* | 6/2016 | Maloney | H01H 71/2472 335/15 |
| 2016/0379789 | A1* | 12/2016 | Fasano | H01H 71/40 335/18 |
| 2017/0032905 | A1* | 2/2017 | Fasano | H01H 9/26 |
| 2017/0047185 | A1* | 2/2017 | Fasano | H01H 71/08 |
| 2017/0103861 | A1* | 4/2017 | Reid | H01H 9/02 |
| 2018/0123326 | A1* | 5/2018 | Luoma | H02B 1/26 |
| 2018/0130616 | A1* | 5/2018 | Fasano | H01H 73/12 |
| 2018/0218864 | A1* | 8/2018 | Fasano | H01H 50/041 |
| 2019/0019636 | A1* | 1/2019 | Maloney | H01H 9/02 |
| 2019/0074153 | A1* | 3/2019 | Fasano | H01H 71/04 |

FOREIGN PATENT DOCUMENTS

| | | | |
|---|---|---|---|
| EP | 2015340 | A2 | 1/2009 |
| JP | 07094070 | A | 7/1995 |
| JP | 2001160354 | A | 12/2001 |
| KR | 10035720200000 | | 10/2002 |
| KR | 1020060027950 | A | 3/2006 |
| KR | 100574895 | A | 4/2006 |
| KR | 20044157800000 | | 8/2008 |
| KR | 100854387 | B1 | 9/2008 |
| KR | 20110135236 | A | 12/2011 |

OTHER PUBLICATIONS

European Search Report for related European Application No. 17211021.5; report dated May 9, 2018; (10 pages).

Chinese Office Action for related Chinese Application No. 201810011270.0; action dated Dec. 21 2018; (11 pages).

* cited by examiner

MAGNETIC TRIP DEVICE FOR CIRCUIT BREAKER

CROSS-REFERENCE TO RELATED APPLICATIONS

Pursuant to 35 USC § 119(a), this application claims the benefit of an earlier filing date of and the right of priority to Korean Application No. 10-2017-0001986, filed on Jan. 5, 2017, which is herein expressly incorporated by reference in its entirety.

BACKGROUND OF THE INVENTION

1. Field of the Invention

The present disclosure relates to a circuit breaker, and more particularly to, a magnetic trip device for a circuit breaker.

2. Description of the Related Art

The present disclosure may be applicable to an air circuit breaker, particularly a small air circuit breaker, but may not be necessarily applicable to only a small air circuit breaker, and may be also applicable to various circuit breakers having a magnetic trip device.

For a prior art relating to such a magnetic trip device, the following patent documents assigned to the applicant of the present disclosure may be referred to.

Korean Patent Registration No. 10-1082175 (Title of invention: Circuit breaker with trip alarm means) Korean Patent Registration No. 10-0905019 (Title of invention: Circuit breaker having trip signal output device)

However, a magnetic trip device of a conventional circuit breaker including the related art according to the foregoing patent documents has a problem in which there is no means capable of maintaining fault information indicating until a user removes the cause of an accident subsequent to a trip operation and resets the magnetic trip device.

Such a problem may pose a risk of causing serious an electrical safety accident when the circuit breaker is operated to a closed position (a so-called ON position) prior to eliminating the cause of the accident.

SUMMARY OF THE INVENTION

Accordingly, the present disclosure is to solve the problems in the related art, and an object of the present disclosure is to provide a magnetic trip device for a circuit breaker capable of maintaining fault information indication until a user removes the cause of an accident subsequent to a trip operation and resets the magnetic trip device.

The object of the present disclosure may be accomplished by providing a magnetic trip device for a circuit breaker, comprising: an actuator coil part that has a plunger configured to move to an advanced position or a retracted position according to the magnetization or demagnetization of a coil; an output plate that is rotatably provided on the movement path of the plunger to rotate in a first direction by the pressing of the plunger; a micro switch that has an operation lever portion protruding outwardly and is configured to output an electrical signal indicating a state of the circuit breaker according to whether or not the operation lever portion is pressed; a switch driving lever mechanism that is configured to rotate to a first position for pressing the operation lever portion or a second position for releasing the operation lever portion so as to open or close the micro switch; a driving lever bias spring that is provided at a predetermined position to elastically bias the switch driving lever mechanism to rotate to the second position; an automatic reset mechanism that is configured to press the plunger of the actuator coil part to the retracted position in connection with a main switching shaft of the circuit breaker subsequent to a trip operation; and a driving lever latch that is configured to rotate to a restraining position for preventing the switch driving lever mechanism from rotating to the first position so as to allow the micro switch to maintain a trip indicating state subsequent to a trip operation even when the plunger is moved to the retracted position by the automatic reset mechanism, and a release position for allowing the switch driving lever mechanism to rotate to the first position, and the driving lever latch is provided adjacent to the switch driving lever mechanism.

According to a preferred aspect of the present disclosure, the magnetic trip device of the circuit breaker according to the present disclosure further comprises a manual reset lever that is provided at a position capable of pressing the driving lever latch and presses the driving lever latch to rotate to the release position while being moved by a manual operation force.

According to another preferred aspect of the present disclosure, the driving lever latch comprises a rotating shaft portion; a hook portion that extends from the rotating shaft portion toward the switch driving lever mechanism to restrain the switch driving lever mechanism; and a release driving force receiving portion that extends from the rotating shaft portion to an opposite side of the hook portion to be brought contact with the manual reset lever, wherein the manual reset lever comprises a pressing protrusion portion that is configured to press the release driving force receiving portion to rotate the driving lever latch to the release position According to still another preferred aspect of the present disclosure, a surface of the release driving force receiving portion facing the pressing protrusion portion is configured with an inclined surface.

According to yet still another preferred aspect of the present disclosure, a surface of the release driving force receiving portion facing the pressing protrusion portion is configured with a curved surface.

According to still yet another preferred aspect of the present disclosure, the switch driving lever mechanism comprises an arm that extends toward the operation lever portion of the micro switch and is rotatable to a first position for pressing the operation lever portion of the micro switch and a second position for releasing the operation lever portion; and a switch driving lever that is capable of rotating the arm, wherein the switch driving lever comprises a rotating shaft portion; a first lever portion that extends from the rotating shaft portion toward the output plate and is rotatable according to the output plate; an arm contact surface portion that contacts with the arm to transmit a driving force to the arm so as to rotate the arm to the first position or the second position; and a third lever portion that extends upward from the rotating shaft portion to be restrained by the driving lever latch or released from the driving lever latch.

According to yet still another preferred aspect of the present disclosure, the magnetic trip device of the circuit breaker according to the present disclosure further comprises a latch bias spring configured to apply an elastic force to the driving lever latch to rotate in one direction.

According to still yet another preferred aspect of the present disclosure, the latch bias spring is configured with a torsion spring.

According to yet still another preferred aspect of the present disclosure, the magnetic trip device of the circuit breaker according to the present disclosure further comprises a return spring configured to apply an elastic force to the output plate to return to an initial position.

According to still yet another preferred aspect of the present disclosure, an elastic modulus of the return spring is larger than an elastic modulus of the driving lever bias spring.

According to yet still another preferred aspect of the present disclosure, further comprises a pair of guide members formed in a protruding manner on an inner wall surface of an enclosure of the magnetic trip device and formed in a predetermined length at a higher position and at a lower position than the manual reset lever respectively so as to guide the manual reset lever to horizontally move due to a manual operation force.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

The foregoing objective of the present invention, as well as the configuration to accomplish the foregoing objective and technical effect thereof will be more clearly understood by the following description for preferred embodiments of present disclosure with reference to the accompanying drawings.

Figure 1:
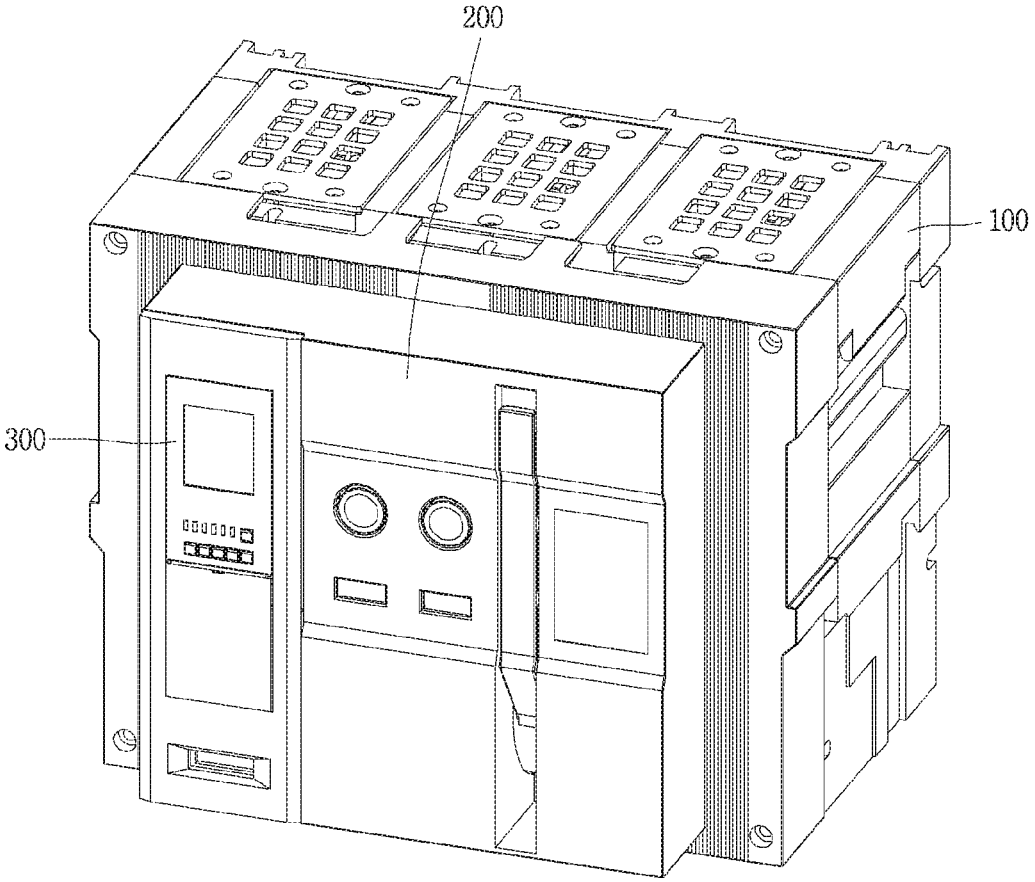
FIG. 1 is a perspective view illustrating an outline of an air circuit breaker to which a magnetic trip device of a circuit breaker according to the present disclosure is applicable.

A circuit breaker, for example, an air circuit breaker, on which a magnetic trip device according to a preferred embodiment of the present disclosure is mountable (applicable), may be configured with reference to FIG. 1.

Referring to FIG. 1, an air circuit breaker includes a main body 100 having a switching mechanism for each pole and an arc extinguishing mechanism for each pole, and a front panel part 200 having an operation and display unit, and an over current relay 300 corresponding to a controller of the air circuit breaker is provided at one side of the front panel part 200. FIG. 1 is an external perspective view illustrating only the external shapes of the constituent parts.

On the other hand, the configuration of a magnetic trip device of a circuit breaker according to a preferred embodiment of the present disclosure will be described as follows mainly with reference to FIGS. 2 and 3.

As illustrated in the drawing, a magnetic trip device 20 of a circuit breaker according to a preferred embodiment of the present disclosure comprises an actuator coil part 21, an output plate 22, a micro switch 28, a switch driving lever mechanism (26, 27), a driving lever bias spring 32, an automatic reset mechanism 23, and a driving lever latch 29.

Figure 2:
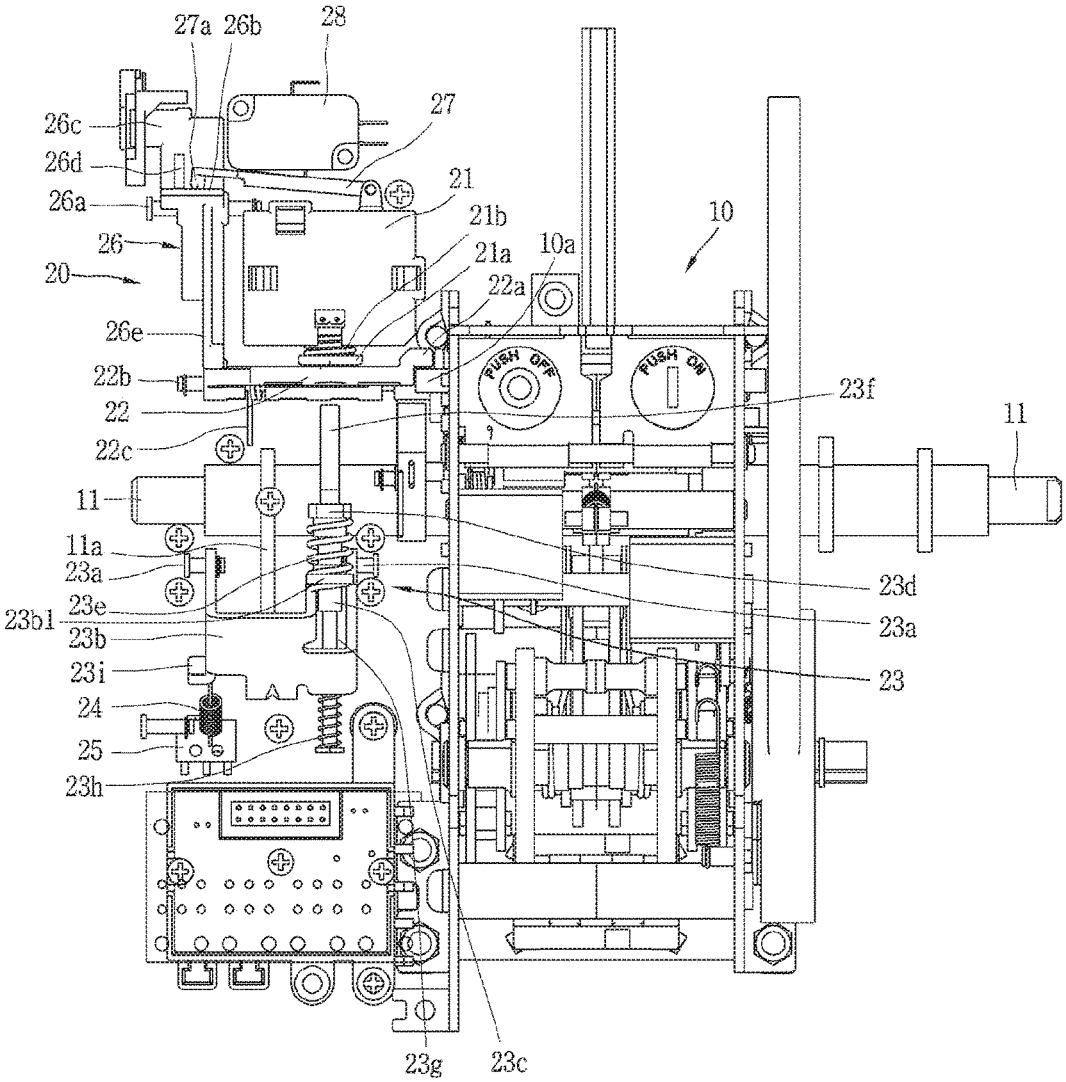
FIG. 2 is a front view illustrating a magnetic trip device, a switching mechanism, and a main switching shaft of a circuit breaker according to an embodiment of the present disclosure in a closed state and in a state where alarm indication is stopped.
Figure 3:
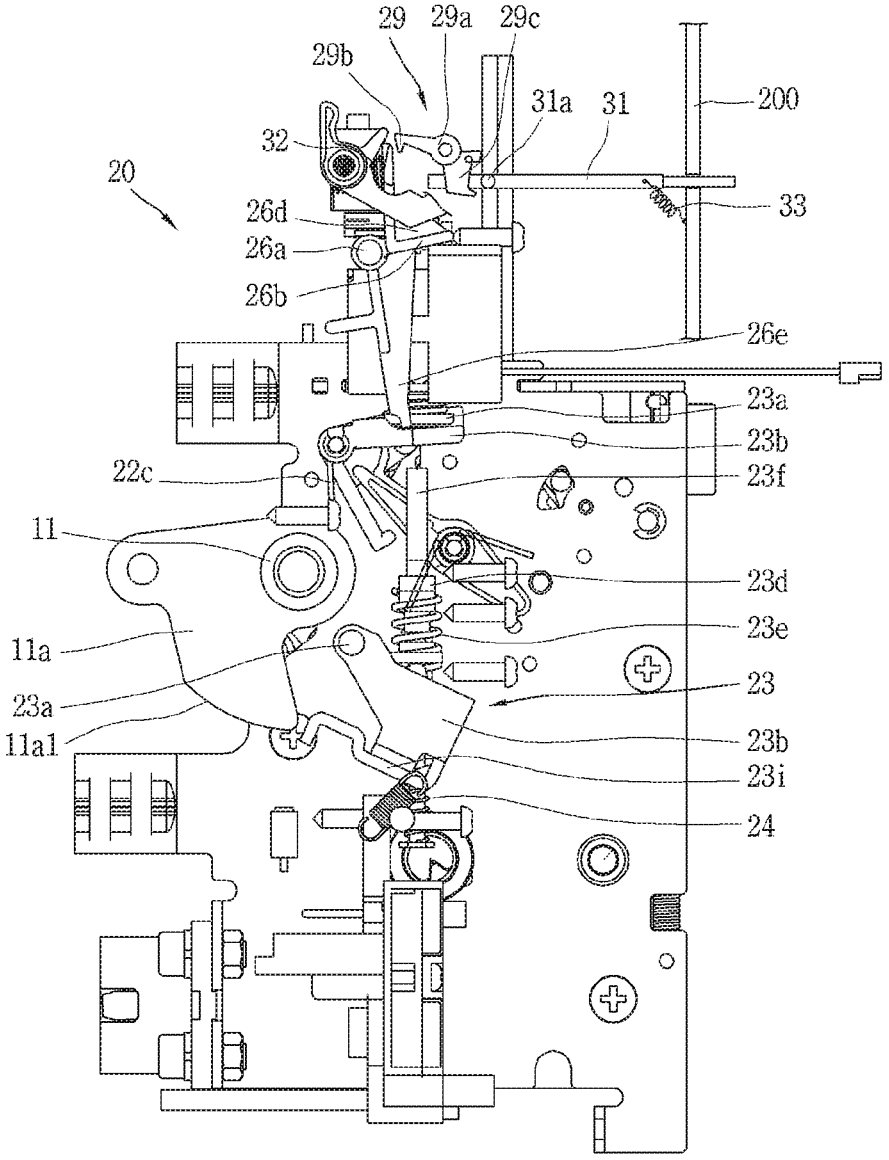
FIG. 3 is a left side view illustrating a magnetic trip device, a switching mechanism, and a main switching shaft of a circuit breaker according to an embodiment of the present disclosure in the state of FIG. 2.

Referring to FIGS. 2 and 3, and the like, reference numeral 10 designates a switching mechanism of the circuit breaker, and the switching mechanism 10 includes a trip spring as an energy source for a trip operation (automatic circuit breaking operation), and a closing spring as an energy source for a closing operation (a so-called ON operation), a power transmission mechanism, a movable contact, a stationary contact, and the like.

The more detailed description of the switching mechanism 10 and the configuration thereof can be referred to a laid open disclosure of Korean Patent No. 10-1100709 granted to the applicant of the present disclosure, and the detailed description thereof will be omitted.

Referring to FIGS. 2 and 3, and the like, reference numeral 11 designates a main switching shaft commonly connected to a plurality of movable contacts for each phase for a switching operation that operates a closing position for simultaneously bringing a plurality of movable contacts for each phase (pole) into contact with the corresponding stationary contacts, and operates an opening position (tripping) for the plurality of movable contacts to separate from the stationary contacts.

The actuator coil part 21 comprises a coil magnetized or demagnetized according to whether or not a magnetization control signal is received from the over current relay 300, and a plunger 21*a* configured to move an advanced position or retracted position according to the magnetization and demagnetization of the coil.

A buffer spring 21*b* is additionally provided around an axis of the plunger 21*a* to buffer an impact when the plunger 21*a* collides with the output plate 22. Here, the over current relay 300 outputs the magnetization control signal only when the circuit breaker is to be tripped.

The output plate 22 serves as an output unit of the magnetic trip device 20 of the present disclosure, and referring to FIG. 2, the output plate 22 presses a trip lever 10*a* of the switching mechanism 10 for triggering the switching mechanism 10 to perform a trip operation.

The output plate 22 may be provided with a lever pressing portion 22*a* on one side as an operating portion for pressing the trip lever 10*a*.

According to an embodiment, the lever pressing portion 22*a* is provided to protrude upward from the other plate surfaces of the output plate 22 so as to provide a space for an end portion of the trip lever 10*a* to be located immediately therebelow.

A central portion of the output plate 22 is provided with a through hole (refer to FIG. 4, reference number is not shown) for allowing a pressing rod 23*f* corresponding to an upper end portion of a lower automatic reset mechanism 23 to pass therethrough.

It is possible for the pressing rod 23*f* moving upward through the through-hole to push the plunger 21*a* of the actuator coil part 21 so that the plunger 21*a* may move to a retracted position as an initial position.

The triggered switching mechanism 10 discharges elastic energy charged in the trip spring as well known to separate a movable contact from the corresponding stationary contact by interlocking mechanical components included in the switching mechanism 10, thereby completing a trip operation for automatically breaking the circuit.

The output plate 22 is rotatably provided on a movement path of the plunger 21*a*, and rotates in a first direction (clockwise direction in FIG. 3) by the pressing of the plunger 21*a*.

An output plate rotating shaft 22*b* may be provided to rotatably support the output plate 22, and both end portions of the output plate rotating shaft 22*b* may be supported by both side plates of the enclosure of the magnetic trip device 20.

According to a preferred aspect of the present disclosure, the magnetic trip device 20 according to the present disclosure further comprises a return spring 22*c* for applying an elastic force to return the output plate 22 to an initial position.

Accordingly, when the plunger 21*a* is retracted to eliminate a pressure applied to the output plate 22, the output plate 22 returns to the initial position while rotating in a second direction (counter-clockwise in FIG. 3) due to a resilient force imposed by the return spring 22*c*.

According to a preferred aspect, an elastic modulus of the return spring 22*c* may be configured to be greater than that (an elastic modulus) of the driving lever bias spring 32.

Accordingly, when the output plate 22 returns to the initial position while rotating in a counter clockwise direction in the drawing due to an elastic force imposed by the return spring 22*c*, the driving lever bias spring 32 overcomes an elastic force for rotating the switch driving lever 26 which will be described later in a clockwise direction to rotate the switch driving lever 26 in a counter-clockwise direction, and allows the driving lever bias spring 32 to maintain in a state of charging elastic energy (compressed state).

The micro switch 28 is a member for outputting an electrical signal according to whether or not a mechanical pressure is received, and has an operation lever portion (refer to reference numeral 28*a* in FIG. 6) which is protruded outwardly, thereby outputting an electrical signal indicating the state of the circuit breaker whether the operation lever portion is pressed or not.

For instance, when a pressure applied to the operation lever portion 28*a* is released (extinguished), a circuit from an electric power source to an output terminal is connected while an internal contact interlocked with the operation lever portion 28*a* is closed to output an electric signal of a predetermined voltage indicating that the circuit breaker is in a trip operation state.

The switch driving lever mechanism (26, 27) is able to rotate to a first position for pressing the operation lever portion 28*a* or a second position for releasing the operation lever portion 28*a* so as to open or close the micro switch 28.

According to a preferred embodiment, the switch driving lever mechanism (26, 27) includes a switch driving lever 26 and an arm 27.

The switch driving lever 26 is provided as a configuration capable of rotating the arm 27.

The switch driving lever 26 comprises a rotating shaft portion 26*a*, a first lever portion 26*e*, an arm contact surface portion 26*b*, and a third lever portion 26*c*.

The rotating shaft portion 26*a* is a portion that provides a rotational center axis to allow the switch driving lever 26 to rotate.

The first lever portion 26*e* extends from the rotating shaft portion 26*a* toward the output plate 22 (extends downward in the drawing), and contacts with an upper surface of the output plate 22 to be pressed by the output plate 22.

Furthermore, the first lever portion 26*e* is rotatable according to the output plate 22.

In particular, the third lever portion 26*c* corresponding to an upper portion of the switch driving lever 26 receives an elastic force from the driving lever bias spring 32 to rotate in a clockwise direction in FIG. 3. When the output plate 22 is separated from the first lever portion 26*e* to eliminate a pressure that has been pressed while rotating in a clockwise direction due to the pressing of the plunger 21*a*, the first lever portion 26*e* rotates in a clockwise direction due to an elastic force imposed from the driving lever bias spring 32.

The arm contact surface portion 26*b* is a portion that contacts with the arm 27 of the switch driving lever 26 to transmit (transfer) a driving force to the arm 27 such that the arm 27 rotates to the first position or the second position.

The arm contact surface portion 26*b* is located at a longitudinal center portion of the switch driving lever 26. The arm contact surface portion 26*b* extends in a horizontal direction from its center portion to be located below a power receiving end portion 27*a* of the arm 27.

A reinforcing thick portion 26*d* for reinforcing a strength of a third lever portion 26*c* which will be described later may be provided between the arm contact surface portion 26*b* and the third lever portion 26*c*. The reinforcing thick portion 26*d* may be formed to have a substantially triangular side shape as illustrated in FIG. 3.

The third lever portion 26*c* is a portion of the switch driving lever 26 that extends upward from the rotating shaft portion 26*a* to be restrained or released by the driving lever latch 29.

Figure 9:
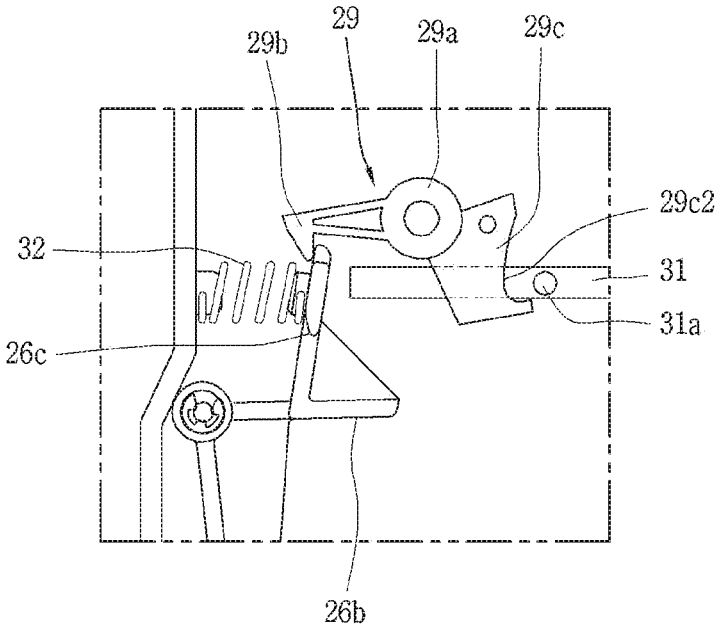
FIG. 9 is an enlarged essential part view illustrating another embodiment of a driving lever latch in a magnetic trip device of a circuit breaker according to the present disclosure.

Referring to FIG. 9, a front end portion of the third lever portion 26*c*, which faces the driving lever latch 29, is formed to have an inclined surface or a curved surface so as to allow a hook portion 29*b* of the driving lever latch 29 which will be described later to ride over easily while being in contact therewith.

Furthermore, according to a preferred embodiment, a rear surface of the third lever portion 26*c* is formed on a flat surface, and thus the third lever portion 26*c* is configured not to be easily released from the hook portion 29*b* of the driving lever latch 29 after the hook portion 29*b* rides over the front end portion of the third lever portion 26*c*.

Furthermore, referring to FIG. 9, according to a preferred aspect, a spring supporting seat portion may be provided as a protruding portion inserted into the driving lever bias spring 32 on a rear surface of the third lever portion 26*c* to support one end portion of the driving lever bias spring 32.

Figure 6:
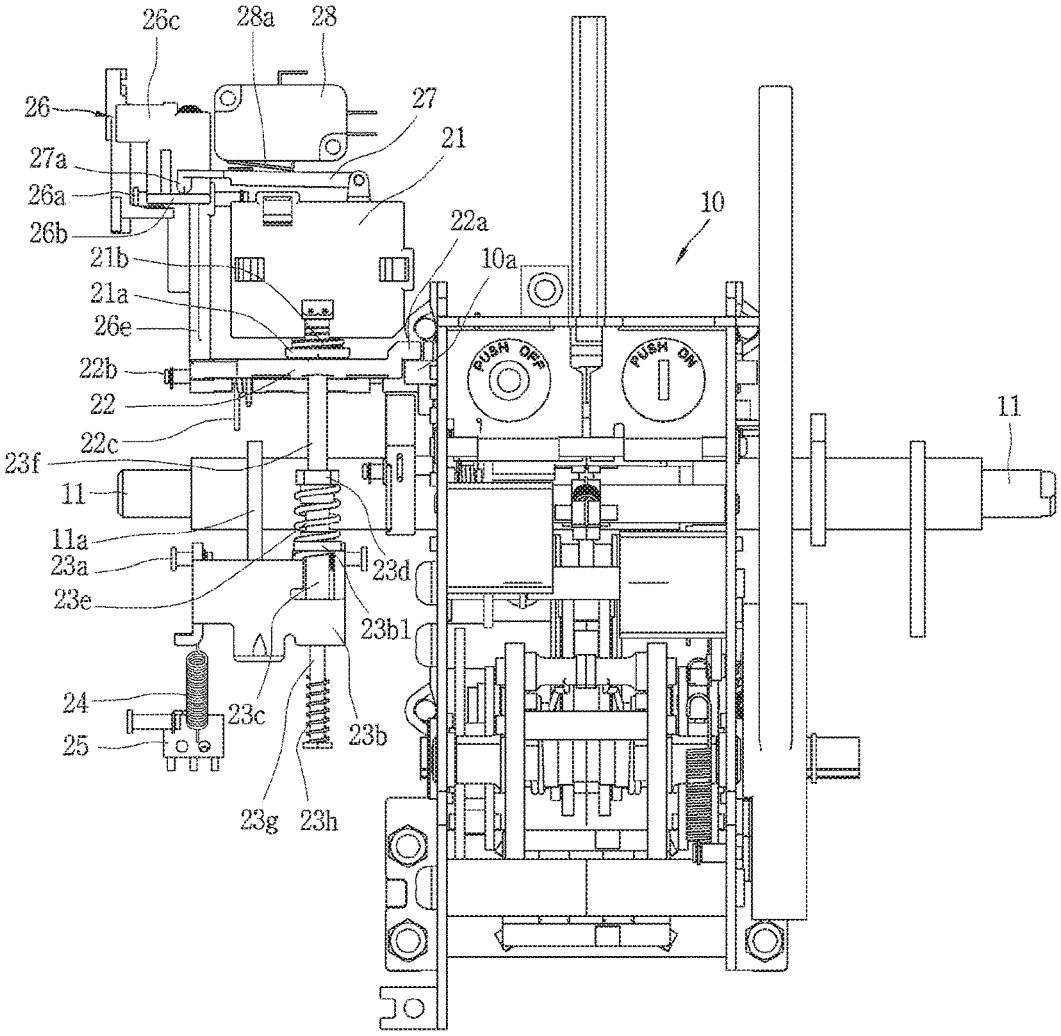
FIG. 6 is a front view illustrating a magnetic trip device, a switching mechanism, and a main switching shaft of a circuit breaker according to an embodiment of the present disclosure in a state in which an actuator coil part is reset to an initial state in a state where an alarm is being indicated.

Referring to FIG. 6, the arm 27 extends toward the operation lever portion 28*a* of the micro switch 28. The arm 27 is rotatable to a first position for pressing the operation lever portion 28*a* of the micro switch 28 or a second position for releasing the operation lever portion 28*a*.

According to an embodiment, one end portion of the arm 27 can be supported by a hinge and a hinge supporting bracket provided at one side of an upper surface of the actuator coil part 21.

According to another preferred embodiment, the switch driving lever mechanism may be configured with only the switch driving lever 26. Such another embodiment is characterized in that the switch driving lever 26 includes a component portion that performs a function of the arm 27.

In other words, as a switch driving lever mechanism according to another preferred embodiment, the switch driving lever 26 may include the rotating shaft portion 26*a*, the first lever portion 26*e*, the second lever portion, and the third lever portion 26*c*.

Since the rotating shaft portion 26*a*, the first lever portion 26*e* and the third lever portion 26*c* have the same function and configuration as those of the portions indicated by the same reference numerals in the switch driving lever mechanism according to the foregoing embodiment, and thus the redundant description of these components will be omitted.

The first lever portion 26*e* extends from the rotating shaft portion 26*a* toward the output plate 22 to be rotatable according to the output plate 22.

The second lever portion is a portion of the switch lever 26 that performs a function of the arm 27, and provided by forming the arm contact surface portion 26*b* of the embodiment to extend toward the operation lever portion 28*a* of the micro switch 28.

The second lever portion is a portion of the switch driving lever 26 that extends from the rotating shaft portion 26*a* toward the operation lever portion 28*a* of the micro switch 28 to be rotatable to a first position for pressing the operation lever portion 28*a* and a position for releasing the operation lever portion 28*a*.

The third lever portion 26*c* extends upward from the rotating shaft portion 26*a* to be restrained (locked) or released by the driving lever latch 29.

Meanwhile, the driving lever bias spring 32 included in the magnetic trip device 20 according to the present disclosure is provided at a predetermined position to elastically press the switch driving lever mechanism to rotate to the second position.

Figure 8:
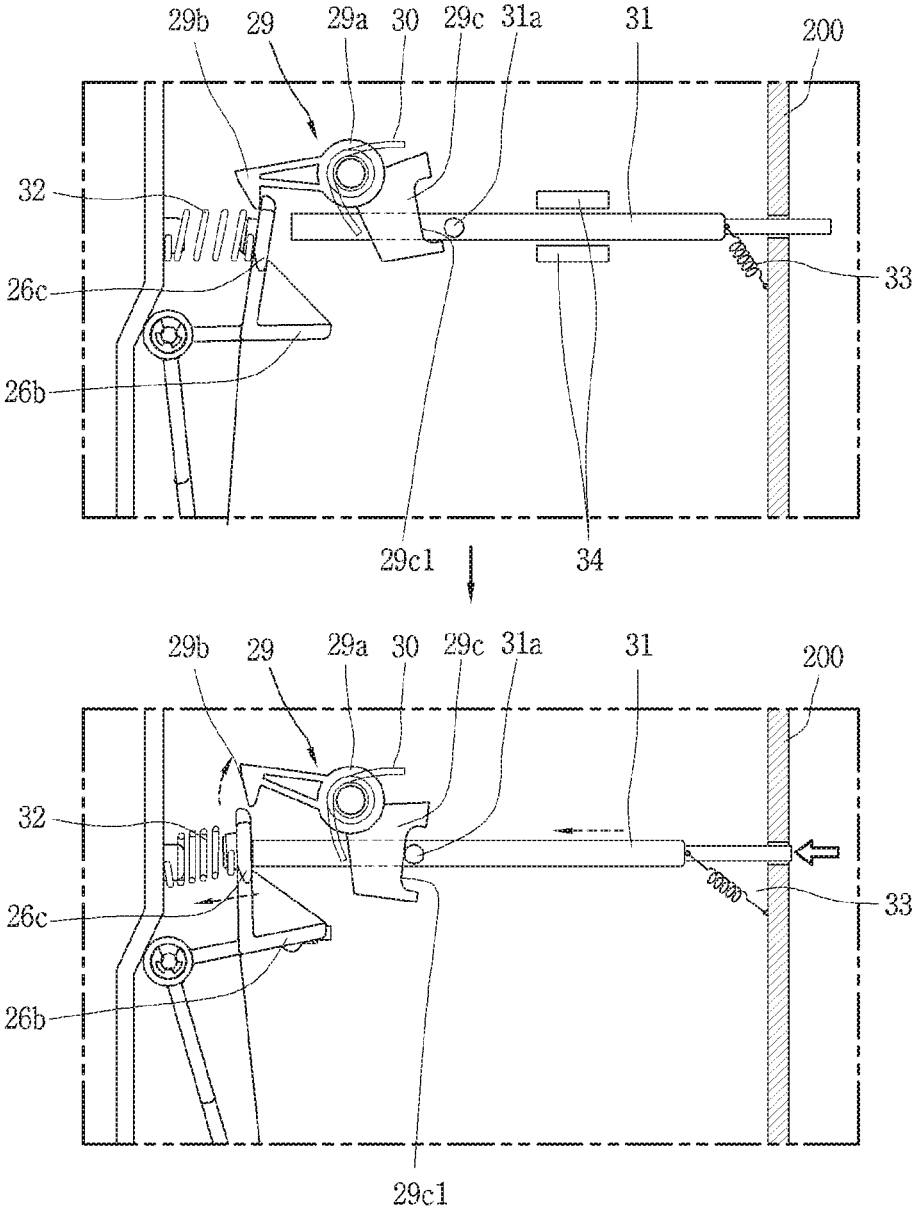
FIG. 8 is an enlarged essential part view in which the operation states of a driving lever bias spring, a switch driving lever, a driving lever latch, and a manual reset lever in a magnetic trip device of a circuit breaker according to an embodiment of the present disclosure are separately enlarged, wherein an upper drawing thereof is an enlarged essential part view in a state where it is restrained in an alarm indicating state, and a lower drawing thereof is an enlarged essential part view in which the driving lever latch releases the restraint of the switch driving lever to stop alarm indicating by the operation of the manual reset lever.

The driving lever bias spring 32 may be configured with a compression spring according to a preferred embodiment, and as illustrated in FIG. 8, an end portion of the driving lever bias spring 32 may be supported by the spring supporting seat portion provided on a rear surface of the third lever portion 26*c*, and the other end thereof may be supported by a spring support member (reference number is not given) fixed to the third lever portion 26*c* and provided to face the third lever portion 26*c*.

The automatic reset mechanism 23 included in the magnetic trip device 20 according to the present disclosure is a mechanism that drives the plunger 21*a* of the actuator coil part 21 to the retracted position in interlocking with the main switching shaft 11 of the circuit breaker subsequent to a trip operation.

A driving lever 11*a* which is rotatable in the same direction as the main switching shaft 11 is provided at a position of the main switching shaft 11 facing the automatic reset mechanism 23 to interlock with the automatic reset mechanism 23.

Here, the driving lever 11*a* has a cam surface portion 11*a*1 whose radius of curvature changes in order to allow the automatic reset mechanism 23 to perform an interlocking operation.

Referring to FIG. 3, the cam surface portion 11*a*1 may be formed on at least a part of an outer circumferential surface of the driving lever 11*a*.

Referring to FIG. 2 or 3, the automatic reset mechanism 23 comprises a rotating shaft 23*a*, a rotating plate 23*b*, a cylinder 23*c*, a bushing 23*d*, a first buffer spring 23*e*, a pressing rod 23*f*, a lower rod 23*g*, a second buffer spring 23*h*, and a power receiving portion 23*i*.

Referring to FIG. 6, the automatic reset mechanism 23 may further comprise a return spring 24 and a spring support member 25.

The rotating shaft 23*a* is fixedly provided to support the rotating plate 23*b* so as to be rotatable. According to a preferred embodiment, the rotary shaft 23*a* may be configured with a pair of protruding shaft portions formed to protrude from a wall surface of the enclosure (not shown) of the magnetic trip device 20 according to the present disclosure.

The rotating plate 23*b* is rotatable around the rotating shaft 23*a*.

The rotating plate 23*b* is provided at a position facing the driving lever 11*a* to be brought into contact with the driving lever 11*a* coupled to the rotating plate 23*b* to rotate together with the main switching shaft 11 at a side of the main switching shaft 11 of the circuit breaker.

Figure 5:
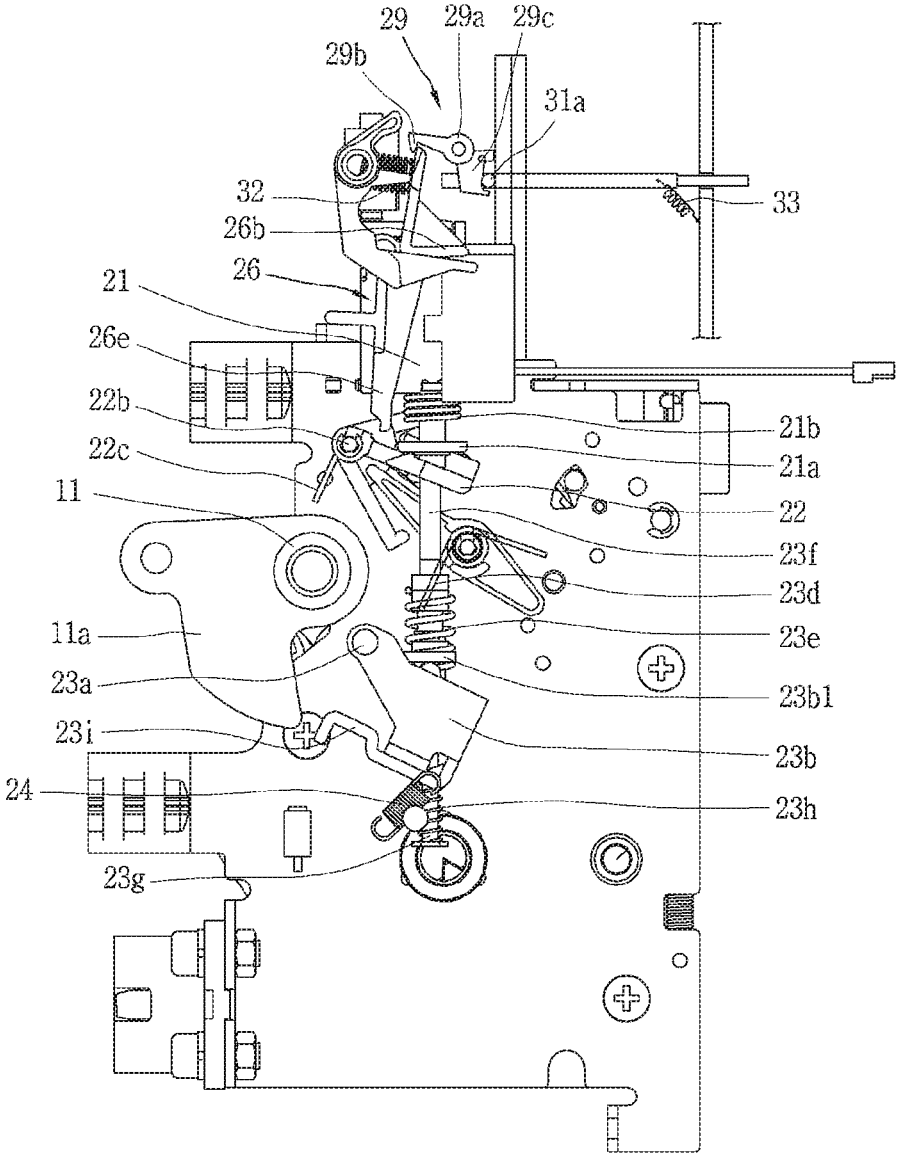
FIG. 5 is a left side view illustrating a magnetic trip device, a switching mechanism, and a main switching shaft of a circuit breaker according to an embodiment of the present disclosure in the state of FIG. 4.

The rotating plate 23*b* may be made of a metallic plate having a substantially U-shape, and comprises both leg portions supported by the rotating shaft 23*a*, a spring seat portion 23*b*1 provided between the both leg portions as a portion for supporting one end portion of the first buffer spring 23*e* and a pair of leg portions 23*a*, and a power receiving portion 23*i* extended to be brought into contact with the driving lever 11*a* as illustrated in FIG. 3 or 5.

The spring seat portion 23*b*1 of the rotating plate 23*b* is provided with a through hole (not shown) for allowing the cylinder 23*c* to pass therethrough in a vertical direction.

Referring to FIG. 3, when the circuit breaker is in a closed state (ON state), the power receiving portion 23*i* is in a state of being separated from the driving lever 11*a* of the main switching shaft 11.

Figure 7:
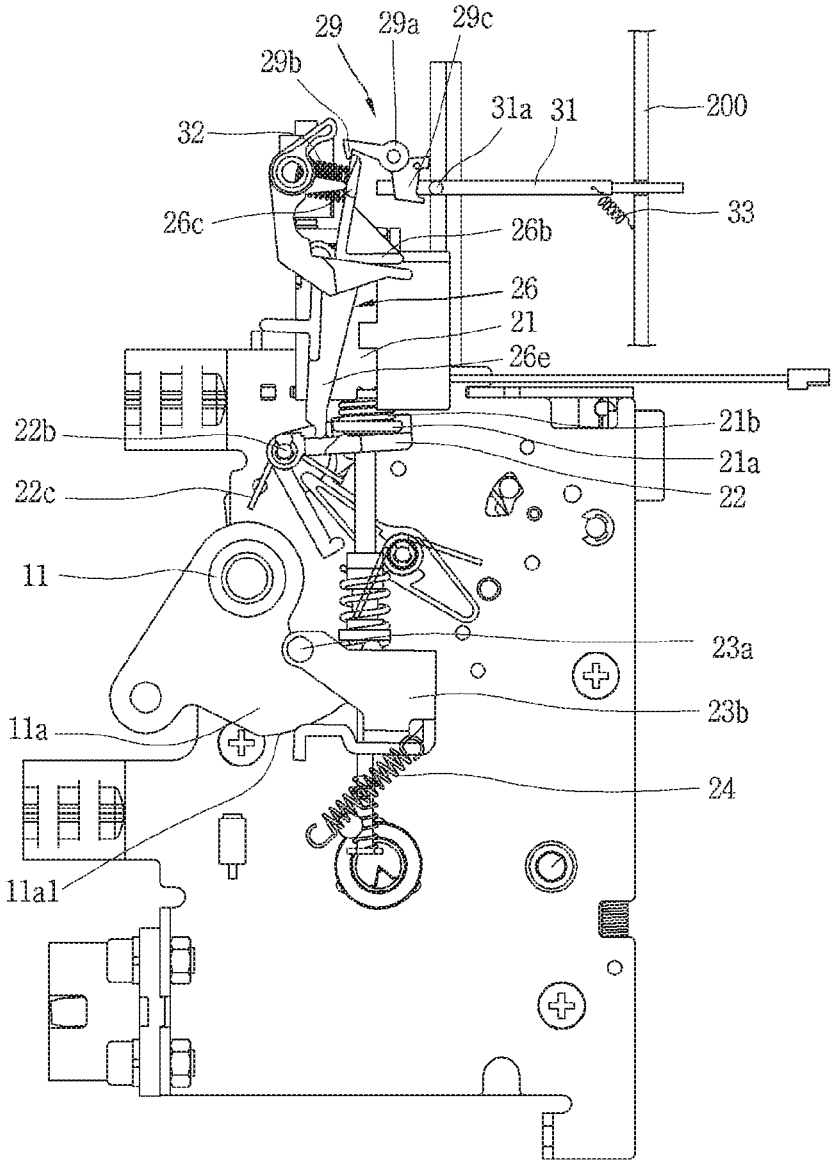
FIG. 7 is a left side view illustrating a magnetic trip device, a switching mechanism, and a main switching shaft of a circuit breaker according to an embodiment of the present disclosure in the state of FIG. 6.

Referring to FIG. 7, when the circuit breaker is in a trip state, the power receiving portion 23*i* is pushed in contact with the cam surface portion 11*a*1 of the driving lever 11*a* being rotated and rotated in a counter-clockwise direction. Here, the rotating plate 23*b* also rotates in a counter-clockwise direction due to a counter-clockwise rotation of the power receiving portion 23*i*, and as a result, the bushing 23*d* connected to the rotating plate 23*b* via the first buffer spring 23*e*, the pressing rod 23*f* and the cylinder 23*c* coupled to the bushing 23*d*, the lower rod 23*g* connected to the cylinder 23*c* by a coupling pin, and the second buffer spring 23*h* provided around the lower rod 23*g* move upward. Thus, the pressing rod 23*f* moving upward presses the plunger 21*a* to return to a retracted position.

A spring supporter (not shown) and through hole portion (not shown) provided at a left and a right side of the spring supporter to allow one end portion of the return spring 24 to pass therethrough may be provided at one side of the power receiving portion 23*i* to engage and support one end portion of the return spring 24.

The return spring 24 may be configured with a tension spring whose one end is supported by the power receiving portion 23*i* and the other end is supported by the spring support member 25.

When the main switching shaft 11 is at a trip position, the return spring 24 is pulled by the rotating plate 23*b* and the power receiving portion 23*i* that rotate in a counter-clockwise direction as illustrated in FIG. 7 to charge elastic energy.

When the main switching shaft 11 is in a closed position (ON position), as illustrated in FIG. 3, the return spring 24 discharges the charged elastic energy to rotate the rotating plate 23*b* and the power receiving portion 23*i* in a clockwise direction.

When the main switching shaft 11 is in a state of being rotated to a closed position (a state of being rotated in a clockwise direction from a position illustrated in FIG. 7 to a position illustrated in FIG. 3), in other words, when the driving lever 11*a* of the main switching shaft 11 is separated from the power receiving portion 23*i*, the return spring 24 applies an elastic force to the rotating plate 23*b* via the power receiving portion 23*i* to rotate the rotating plate 23*b* in a clockwise direction from the position illustrated in FIG. 7 to the position illustrated in FIG. 3.

Due to a clockwise rotation of the power receiving portion 23*i*, the bushing 23*d* connected to the rotating plate 23*b* via the first buffer spring 23*e*, the pressing rod 23*f* and the cylinder 23*c* coupled to the bushing 23*d*, the lower rod 23*g* connected to the cylinder 23*c* by a coupling pin, and the second buffer spring 23*h* provided around the lower rod 23*g* move downward.

The spring support member 25 is fixed in position and may support the other end portion of the return spring 24. The spring support member 25 may be integrally formed with the enclosure (preferably, an enclosure formed by molding a synthetic resin material having electrical insulation properties) of the magnetic trip device 20 according to the present disclosure or configured with a separate body from the enclosure and fixed to the enclosure by a fixing means such as a screw.

A lower portion of the cylinder 23*c* may be placed through the through hole of the rotating plate 23*b*, and a coupling pin (not shown) may be connected to an upper portion of the cylinder 23*c* and the coupling pin may be inserted into a long hole (not shown) provided on the bushing 23*d* and coupled to the bushing 23*d*.

A long hole (not shown) in a vertical direction may be also provided at a lower portion of the cylinder 23*c* and a coupling pin (not shown) connected to the lower rod 23*g* may be inserted into the long hole in the vertical direction and the cylinder 23*c* can be coupled to the lower rod 23*g*.

The bushing 23*d* is integrally coupled to the pressing rod 23*f* to move up and down together.

A diameter of the bushing 23*d* is larger than that (a diameter) of the cylinder 23*c* and that (a diameter) of the first buffer spring 23*e* to support the other end of the first buffer spring 23*e* not to be detached therefrom. As described above, the bushing 23*d* may be provided with a vertical long hole and coupled to the cylinder 23*c* via the coupling pin.

The function of the bushing 23*d* is to support the other end of the first buffer spring 23*e* not to be detached therefrom as described above, and at the same time, to connect the pressing rod 23*f* and the cylinder 23*c* in the middle.

The first buffer spring 23*e* can be configured with a compression spring and provided between the bushing 23*d* and the spring seat portion 23*b*1 of the rotating plate 23*b*. When the pressing rod 23*f* moving upward pushes up the plunger 21*a* of the actuator coil part 21 to a retracted position, the first buffer spring 23*e* buffers an impact while being compressed.

The pressing rod 23*f* corresponds to an output portion of the automatic reset mechanism 23 capable of directly contacting and pressing the plunger 21*a* of the actuator coil part 21, and is provided in an upright posture in a vertical direction.

The pressing rod 23*f* can be coupled to the bushing 23*d* in various methods such as welding, screw coupling, connection pin coupling, and the like.

Referring to FIG. 6, as a coupling pin (not shown) connected to the lower rod 23*g* is inserted into a vertical long hole (not shown) provided at a lower portion of the cylinder 23*c* as described above, the lower rod 23*g* can be coupled to the cylinder 23*c* to move up and down together with the cylinder 23*c* according to the rotation of the rotating plate 23*b*.

The second buffer spring 23*h* is configured with a compression spring according to a preferred embodiment and provided around the lower rod 23*g*.

A flange portion larger than a diameter of the second buffer spring 23*h* is provided at a lower end portion of the lower rod 23*g* to prevent the second buffer springs 23*h* from detaching downward.

The second buffer spring 23*h* absorbs an impact from a lower side applied to the lower rod 23*g*.

On the other hand, the configuration of the driving lever latch 29 of the magnetic trip device 20 according to a preferred embodiment of the present disclosure will be described with reference to FIGS. 3, 5, 7 through 9.

Even when the plunger 21*a* is moved to a retracted position by the automatic reset mechanism 23, the driving lever latch 29 can rotate to a restraining position for preventing the switch driving lever 26 of the switch driving lever mechanism 26, 27 from rotating to the first position so as to allow the micro switch 28 to maintain a trip indication state subsequent to a trip operation and to a releasing position for allowing the rotation of the switch driving lever 26 to rotate to the first position.

The driving lever latch 29 is provided adjacent to the switch driving lever mechanism.

The driving lever latch 29 comprises a rotating shaft portion 29*a*, a hook portion 29*b* and a release drive force receiving portion 29*c* as illustrated in FIG. 8. The rotating shaft portion 29*a* is a portion that provides a rotational center axis portion to allow the switch driving lever 29 to rotate. The rotating shaft portion 29*a* may be formed integrally with the driving lever latch 29 such that both end portions of the rotating shaft portion 29*a* are inserted into and supported by a pair of shaft support groove portions provided on a side wall of the enclosure of the magnetic trip device 20 or may be configured separately from the driving lever latch 29 such that the both end portions are inserted into and supported by the shaft support groove portions.

The hook portion 29*b* is extended toward the switch driving lever 26 of the switch driving lever mechanisms 26, 27 from the rotating shaft portion 29*a* to restrain (lock) the switch driving lever 26 of the switch driving lever mechanisms 26, 27.

The hook portion 29*b* is rotatable around the rotating shaft portion 29*a* to a position for restraining the third lever portion 26*c* of the switch driving lever 26 and a position for releasing the third lever portion 26*c*.

The position (state) of restraining (locking) the third lever portion 26*c* of the switch driving lever 26 can be voluntarily implemented by the third lever portion 26*c* when the third lever portion 26*c* rotates in a clockwise direction in the drawing by the elastic pressing of the driving lever bias spring 32 in a state of alarming that it is in a trip state. In other words, when the third lever portion 26*c* rotates in a clockwise direction in the drawing, the hook portion 29*b* rides over a front end portion of the third lever portion 26*c* formed on an inclined surface or a curved surface to restrain the third lever portion 26*c*.

The position (state) at which the driving lever latch 29 releases the third lever portion 26*c* is achieved by the pressing of the manual reset lever 31 upon the driving lever latch 29.

The manual reset lever 31 includes a pressing protrusion portion 31*a* for pressing the driving lever latch 29 for driving to the release position.

The release drive force receiving portion 29*c* is extended from the rotating shaft portion 29*a* to an opposite side of the hook portion 29*b* and contacts with the manual reset lever 31.

Referring to FIG. 8, for the release driving force receiving portion 29*c*, a surface facing the pressing protrusion portion 31*a* is configured with an inclined surface 29*c*1 according to a preferred embodiment.

Referring to FIG. 9, for the release driving force receiving portion 29*c*, a surface facing the pressing protrusion portion 31*a* is configured with a curved surface 29*c*2 according to another preferred embodiment.

A surface of the release driving force receiving portion 29*c* facing the pressing protrusion portion 31*a* is configured with the inclined surface 29*c*1 or the curved surface 29*c*2, thereby obtaining an effect capable of effectively transforming a pressing force exerted from the manual reset lever 31 to a rotational force of the driving lever latch 31.

The magnetic trip device 20 according to a preferred embodiment of the present disclosure further comprises a bias spring 30 which applies an elastic force to the driving lever latch in one direction. Here, one direction is a counterclockwise direction in the drawing as a direction of rotation of the hook portion 29*b* of the driving lever latch 29 to a position where the third lever portion 26*c* of the switch driving lever 26 is restrained.

According to a preferred embodiment, the bias spring 30 is configured with a torsion spring.

The magnetic trip device 20 according to a preferred embodiment of the present disclosure further comprises a manual reset lever 31 as illustrated in FIGS. 3, 5, 7 through 9.

The manual reset lever 31 is provided at a position capable of pressing the driving lever latch 29 to press the driving lever latch 29 to rotate to the release position while being moved by a manual operation force.

The manual reset lever 31 is configured with a substantially elongated rod-shaped member, and most of the length thereof is located inside the magnetic trip device 20, but a part thereof may be exposed to the outside through the front plate portion 200 of the circuit breaker. A marking may be provided at a portion of the front plate portion 200 where the manual reset lever 31 is exposed to inform the user that it is possible to reset manually when the manual reset lever 31 is pushed.

The magnetic trip device 20 according to a preferred embodiment of the present disclosure may further comprise a pair of guide members 34 formed in a protruding manner on an inner wall surface of the enclosure of the magnetic trip device 20 and formed in a predetermined length to be at a higher position and a lower position than the manual reset lever 31 so as to guide the manual reset lever 31 to horizontally move due to a manual operation force as illustrated in FIG. 8.

As described above, the manual reset lever 31 has a pressing protrusion portion 31*a* for pressing the release driving force receiving portion 29*c* of the driving lever latch 29 to rotate the driving lever latch 29 to the release position.

The magnetic trip device 20 according to a preferred embodiment of the present disclosure further comprises a lever return spring 33 for returning the manual reset lever 31 to its original position when there is no external force (for instance, a force pressed by a user's hand) pressing the manual reset lever 31.

According to an embodiment, the lever return spring 33 may be configured with a tension spring, one end of the lever return spring 33 may be connected to the manual reset lever 31 and the other end of the lever return spring 33 may be fixed to a rear surface of the front plate portion 200 directly or via another member.

On the other hand, the operation of the magnetic trip device 20 of the circuit breaker according to a preferred embodiment of the present disclosure will be described with reference to the drawings.

Figure 4:
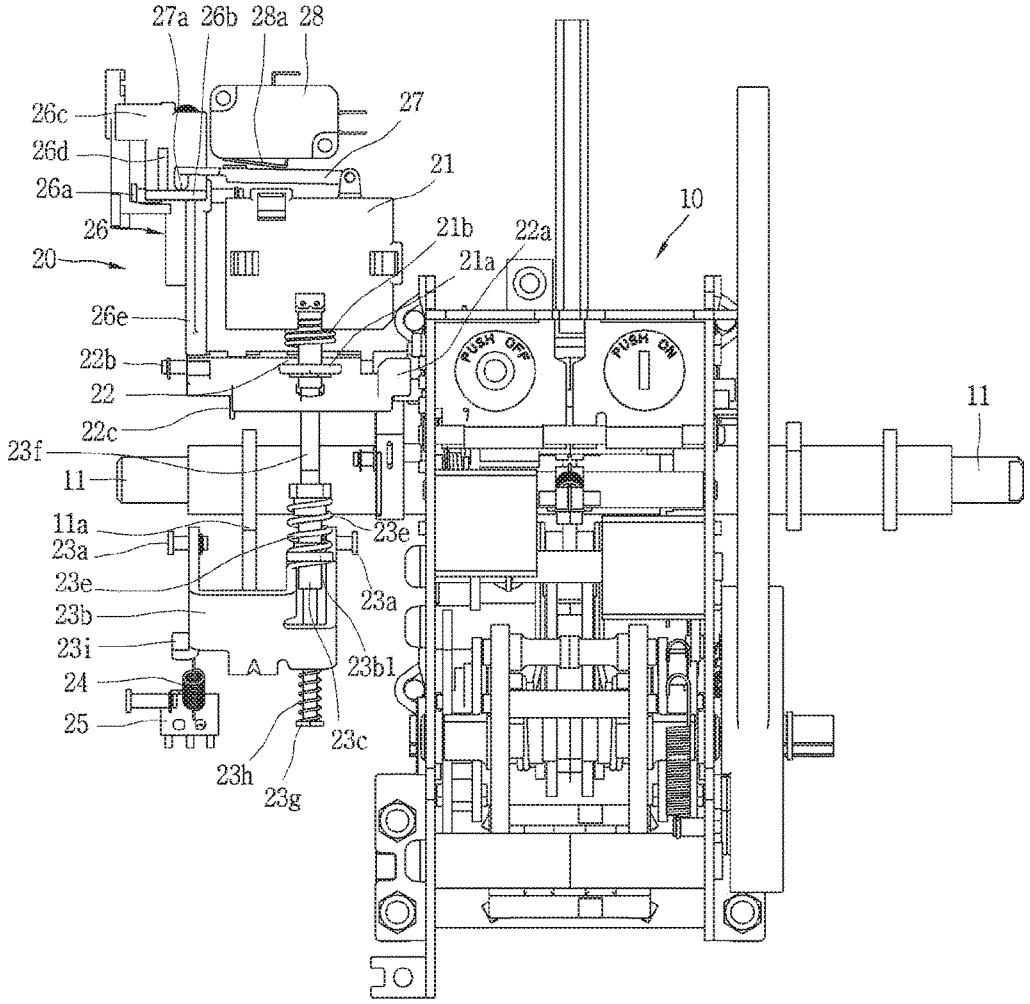
FIG. 4 is a front view illustrating a magnetic trip device, a switching mechanism, and a main switching shaft of a circuit breaker according to an embodiment of the present disclosure in a state where an alarm is being indicated immediately prior to a trip operation in a closed state.

First, a process from which the circuit breaker is in a closed state (a so-called ON state) and also in a state where alarm display is released (stopped) as illustrated in FIGS. 2 and 3 to a state which the circuit breaker is in a state immediately prior to a trip operation (a state immediately prior to trip state from a closed state) and also a state where alarm indicating is performed as illustrated in FIGS. 4 and 5 will be described with reference to FIGS. 2 through 5.

Here, the operation to an alarm indicating state is first carried out before the circuit breaker operates from a closed state to a trip state.

In the state of FIGS. 2 and 3, it is assumed that the over current relay 300 of FIG. 1 senses the occurrence of a fault current such as an over current or an electric shortage current on a circuit to output a trip control signal for breaking the circuit to the magnetic trip device 20 according to a preferred embodiment of the present disclosure.

Then, the trip control signal is transmitted to the actuator coil part 21 of the magnetic trip device 20 through an unillustrated signal line which is wired as a signal transmission path between the over current relay 300 and the magnetic trip device 20 to magnetize the coil (not shown) of the actuator coil part 21.

The plunger 21*a* presses a lower output plate 22 while moving forward according to the magnetization of the coil.

Then, the lower output plate 22 overcomes an elastic force of the return spring 22*c* from a substantially horizontal state as illustrated in FIGS. 2 and 3 and rotates in a clockwise direction as illustrated in FIGS. 4 and 5 to become a state in which one side thereof is inclined downward.

As the output plate 22 rotates in a clockwise direction, the lever pressing portion 22*a* presses the trip lever 10*a* located immediately therebelow. Therefore, the switching mechanism 10 operates to a trip position due to the displacement of the trip lever 10*a*.

The output plate 22 is rotated in a clockwise direction as illustrated in FIGS. 4 and 5 to release the first lever portion 26*e* of the switch driving lever 26.

As a result, the driving lever bias spring 32 which elastically biases the third lever portion 26*c* of the switch driving lever 26 to rotate in a clockwise direction in the drawing is extended while pushing the third lever portion 26*c*, and thus the switch driving lever 26 is rotated in a clockwise direction as illustrated in FIG. 5.

Accordingly, as the hook portion 29*b* of the driving lever latch 29 facing an upper end portion of the third lever portion 26*c* rides over the upper end portion of the third lever portion 26*c* rotating in a clockwise direction, the third lever portion 26*c* of the switch driving lever 26 is restrained (latched) by the driving lever latch 29 in a state of rotating in a clockwise direction.

Here, the arm contact surface portion 26*b* of the switch driving lever 26 is also disengaged from the power receiving end portion 27*a* of the arm 27 while also rotating in a clockwise direction, and as a result, the arm 27 is rotated from a position illustrated in FIG. 2 to a position illustrated in FIG. 4 in a counter-clockwise direction by its own weight. Therefore, the operation lever portion 28*a* of the micros switch 28 which has been pressed by the arm 27 in FIG. 2 is released.

When the operation lever portion 28*a* is released, a circuit from an electric power source to an output terminal can be connected while an internal contact interlocked with the operation lever portion 28*a* is closed to output an electric signal of a predetermined voltage indicating that the circuit breaker is in a trip operation state from the micro switch 28.

Therefore, the electric signal of the predetermined voltage may operate an outer alarm device of the circuit breaker, that is, for instance, an alarm lamp, a buzzer, and the like of a front display operation panel of a switchgear accommodating the circuit breaker, thereby alarming that the circuit breaker is in a trip operation state in which a fault current is currently broken.

As described above, according to the present disclosure, since the state is restrained (locked) by the driving lever latch 29 in a state where the switch driving lever 26 is rotated in a clockwise direction, a trip indicating state can be maintained after the trip operation, thereby preventing the occurrence of an electrical safety accident that may occur by operating the circuit breaker to a closed position (i.e., an ON position) before removing the cause of trip.

On the other hand, an operation in which after a trip operation is completed by the operation of the switching mechanism 10 in an alarm indicating state as illustrated in FIGS. 4 and 5, the actuator coil part is reset to an initial state by the automatic reset mechanism as illustrated in FIG. 6 and FIG. 7 will be described.

When the circuit breaker completes a trip operation, the main switching shaft 11 rotates in a counter-clockwise direction from a state illustrated in FIG. 3 to a state illustrated in FIG. 7.

As the main switching shaft 11 rotates in a counter-clockwise direction, the driving lever 11*a* coupled to the main switching shaft 11 to rotate together also rotates in a counter-clockwise direction.

Referring to FIG. 7, when the circuit breaker is in a trip state, the power receiving portion 23*i* is pushed by the cam surface portion 11*a*1 in contact with the cam surface portion 11*a*1 of the driving lever 11*a* to become a state of being rotated in a counter-clockwise direction from the state illustrated in FIG. 3.

At this time, the rotating plate 23*b* also rotates in a counter-clockwise direction due to a counter-clockwise rotation of the power receiving portion 23*i*, and as a result, the bushing 23*d* connected to the rotating plate 23*b* via the first buffer spring 23*e*, the pressing rod 23*f* and the cylinder 23*c* coupled to the bushing 23*d*, the lower rod 23*g* connected to the cylinder 23*c* through a coupling pin, and the second buffer spring 23*h* provided around the lower rod 23*g* move upward.

Thus, the pressing rod 23*f* moving upward presses the plunger 21*a* of the actuator coil part 21 to return to a retracted position. As a result, the initialization operation of the actuator coil part 21 is completed.

Furthermore, since a pressure of the plunger 21*a* which has pressed the output plate 22 downward is eliminated at this time, the output plate 22 is rotated in a counter-clockwise direction by an elastic force the return spring 22*c* from a clockwise rotation state as illustrated in FIGS. 4 and 5 to become a horizontal state illustrated in FIGS. 6 and 7.

On the other hand, referring to FIG. 8, an operation for operating the manual reset lever 31 in a state where a fault cause of a trip is removed to initialize the driving lever latch 29 to a release position and stop an alarm indicating operation will be described as follows.

After the circuit breaker trips to remove the cause of a fault current such as an overcurrent or an electric shortage current on a circuit, the circuit breaker can be operated again to a closed state (an ON state), and maintaining the alarm indication of the switch driving lever 26 by the driving lever latch 29 to alarm that it is in a trip state is no longer necessary.

At this time, referring to a lower drawing of FIG. 8, when a user pushes the manual reset lever 31 protruding out of the front plate portion 200 of the circuit breaker in an arrow direction, the pressing protrusion portion 31*a* presses the release drive force receiving portion 29*c* of the driving lever latch 29.

As a result, the driving lever latch 29 rotates in a clockwise direction around the rotating shaft portion 29*a*, and accordingly, the hook portion 29*b* is disengaged from the third lever portion 26*c* of the switch driving lever 26.

At this time, the first lever portion 26*e*, which is a lower portion of the switch driving lever 26, is pressed upward by the output plate 22 in the state as illustrated in FIGS. 6 and 7, and is rotated in a counter-clockwise direction around the rotating shaft portion 26*a* to become the state as illustrated in FIG. 3.

Accordingly, as illustrated in FIG. 2, the arm contact surface portion 26*b* of the switch driving lever 26 rotating in a counter-clockwise direction presses the arm 27 while moving upward, and as a result, the arm 27 rotates in a clockwise direction to press the operation lever portion 28*a* of the micro switch 28.

Accordingly, a circuit from an electric power source to an output terminal is broken while an internal contact interlocking with the operation lever portion 28*a* is open, an electric signal of a predetermined voltage indicating that the circuit breaker is in a trip operation state is not outputted from the micro switch 28.

Thus, alarm indication alarming that the circuit breaker is in a trip state is stopped.

Furthermore, at this time, the driving lever bias spring 32 returns to a compressed state in which elastic energy is charged as illustrated in FIG. 3 by a counter-clockwise rotation of the switch driving lever 26.

The technical effects of this disclosure according to claims will be described as follows.

As described above, the magnetic trip device of a circuit breaker according to the present disclosure includes the driving lever latch that is rotatable to the restraining position for preventing the switch driving lever mechanism from rotating to a first position even when the plunger is moved to a retracted position by the automatic reset mechanism so as to allow the micro switch to maintain a trip indicating state subsequent to a trip operation, or the release position for allowing the switch driving lever mechanism to rotate to the first position, and thus the switch driving lever mechanism can be restrained by the driving lever latch subsequent to the trip operation to maintain a trip indicating state subsequent to the trip operation, thereby having an effect capable of preventing the occurrence of an electrical safety accident caused by operating the circuit breaker to a closed position (i.e., ON position) in a state where the cause of the trip is not solved.

The magnetic trip device for a circuit breaker according to the present disclosure further comprises the manual reset lever, and thus the driving lever latch can be forcibly rotated to the release position by removing the cause of a fault and then manually operating the manual reset lever, thereby having an effect capable of operating the magnetic trip device to stop a trip indicating state.

In the magnetic trip device for a circuit breaker according to the present disclosure, the driving lever latch includes a release driving force receiving portion contacts with the rotating shaft portion, the hook portion, and the manual reset lever, and the manual reset lever is provided with a pressing protrusion portion, and thus the driving lever latch is rotatable around the rotating shaft portion, and is capable of restraining the switch driving lever mechanism by the hook portion, and receive a driving force transmitted from the pressing protrusion portion of the manual reset lever to the release driving force receiving portion, thereby is capable of allowing the driving lever latch to rotate to the release position.

In the magnetic trip device for a circuit breaker according to the present disclosure, a surface facing the pressing protrusion portion of the release driving force receiving portion is configured with an inclined surface, thereby having an advantage capable of effectively transforming a pressing force from the manual reset lever into a rotational force of the driving lever latch.

In the magnetic trip device for a circuit breaker according to the present disclosure, a surface facing the pressing protrusion portion of the release driving force receiving portion is configured with a curved surface, thereby having an advantage capable of effectively transforming a pressing force from the manual reset lever into a rotational force of the driving lever latch.

In the magnetic trip device for a circuit breaker according to the present disclosure, the switch driving lever mechanism includes a switch driving lever, and the switch driving lever includes a rotating shaft portion, a first lever portion rotatable along the output plate, a second lever portion rotatable to a first position for pressing the operation lever portion of the micro switch or a position for releasing the operation lever portion, and a third lever portion extended upward from the rotating shaft portion, thereby having an effect capable of allowing the first lever portion to rotate around the rotating shaft portion along the output plate, and operable the micro switch to switch by the second lever portion, and is capable of being restrained or released by the driving lever latch through the third lever portion.

In the magnetic trip device for a circuit breaker according to the present disclosure, the switch driving lever mechanism includes an arm rotatable to a first position for pressing the operation lever portion of the micro switch, and a second position for releasing the operation lever portion, and a switch driving lever capable of rotating the arm, and the switch driving lever includes a rotating shaft portion, a first lever portion rotatable along the output plate, an arm contact surface portion for contacting with the arm to transmit a driving force to the arm to rotate to the first or second position, and a third lever portion extending upward from the rotating shaft portion, thereby obtaining an effect capable of switching the micro switch by the arm contact surface portion and the arm, allowing the first lever portion to rotate around the rotating shaft portion along the output plate, and being restrained or released by the driving lever latch through the third lever portion.

The magnetic trip device for a circuit breaker according to the present disclosure further comprises a bias spring that applies an elastic force to the driving lever latch to rotate in one direction, thereby obtaining an effect capable of allowing the driving lever latch to rotate by an elastic force of the bias spring in a direction of restraining the switch driving lever mechanism if the manual reset lever has no external force for forcibly rotating the driving lever latch to a release position when the one direction is a direction of rotating the driving lever latch such that the hook portion of the driving lever latch restrains (locks) the switch driving lever mechanism.

In the magnetic trip device for a circuit breaker according to the present disclosure, the bias spring is configured with a torsion spring, thereby obtaining an effect capable of allowing the torsion spring to elastically press the driving lever latch to rotate in one direction when a central body portion of the torsion spring is provided to be wound around the rotating shaft portion of the driving lever latch.

The magnetic trip device for a circuit breaker according to the present disclosure further comprises a return spring for imposing an elastic force to return the output plate to an initial position, thereby obtaining an effect capable of allowing the output plate to automatically return to the initial position due to an elastic force from the return spring when a pressing force applied to the output plate from the plunger of the actuator coil part is removed (in other words, when the plunger moves to a retracted position).

In the magnetic trip device for a circuit breaker according to the present disclosure, an elastic modulus of the return spring is larger than that of the driving lever bias spring, thereby obtaining an effect capable of allowing the driving lever bias spring to overcome an elastic force for rotating the switch driving lever in a clockwise direction and rotate the switch driving lever in a counter-clockwise direction, and maintaining the drive lever bias spring in a state where elastic energy is charged (compressed state) when the output plate is returned to an initial position by an elastic force imposed by the return spring.

The magnetic trip device for a circuit breaker according to the present disclosure further comprises a pair of guide members formed to protrude from an inner wall surface of the enclosure of the magnetic trip device and formed in a predetermined length to be higher and lower than the manual reset lever, thereby having an effect capable of guiding the manual reset lever to horizontally move by a manual operation force so as to allow the manual reset lever to accurately achieve the driving of the driving lever latch to a release position.

What is claimed is:

1. A magnetic trip device for a circuit breaker, comprising:

an actuator coil part that has a plunger configured to move to an advanced position or a retracted position according to the magnetization or demagnetization of a coil;

an output plate that is rotatably provided on the movement path of the plunger to rotate in a first direction by the pressing of the plunger;

a micro switch that has an operation lever portion protruding outwardly and is configured to output an electrical signal indicating a state of the circuit breaker according to whether or not the operation lever portion is pressed;

a switch driving lever mechanism that is configured to rotate to a first position for pressing the operation lever portion or a second position for releasing the operation lever portion so as to open or close the micro switch;

a driving lever bias spring that is provided at a predetermined position to elastically bias the switch driving lever mechanism to rotate to the second position;

an automatic reset mechanism that is configured to press the plunger of the actuator coil part to the retracted position in connection with a main switching shaft of the circuit breaker subsequent to a trip operation; and a driving lever latch that is configured to rotate to a restraining position for preventing the switch driving lever mechanism from rotating to the first position so as to allow the micro switch to maintain a trip indicating state subsequent to a trip operation even when the plunger is moved to the retracted position by the automatic reset mechanism, and a release position for allowing the switch driving lever mechanism to rotate to the first position, and the driving lever latch is provided adjacent to the switch driving lever mechanism.

2. The magnetic trip device of claim 1, further comprising:

a manual reset lever that is provided at a position capable of pressing the driving lever latch and presses the driving lever latch to rotate to the release position while being moved by a manual operation force.

3. The magnetic trip device of claim 2, wherein the driving lever latch comprises:

a rotating shaft portion;

a hook portion that extends from the rotating shaft portion toward the switch driving lever mechanism to restrain the switch driving lever mechanism; and a release driving force receiving portion that extends from the rotating shaft portion to an opposite side of the hook portion to be brought contact with the manual reset lever, wherein the manual reset lever comprises a pressing protrusion portion that is configured to press the release driving force receiving portion to rotate the driving lever latch to the release position.

4. The magnetic trip device of claim 3, wherein a surface of the release driving force receiving portion facing the pressing protrusion portion is configured with an inclined surface.

5. The magnetic trip device of claim 3, wherein a surface of the release driving force receiving portion facing the pressing protrusion portion is configured with a curved surface.

6. The magnetic trip device of claim 2, further comprising a pair of guide members formed in a protruding manner on an inner wall surface of an enclosure of the magnetic trip device and formed in a predetermined length at a higher position and at a lower position than the manual reset lever respectively so as to guide the manual reset lever to horizontally move due to a manual operation force.

7. The magnetic trip device of claim 1, wherein the switch driving lever mechanism comprises:

an arm that extends toward the operation lever portion of the micro switch and is rotatable to a first position for pressing the operation lever portion of the micro switch and a second position for releasing the operation lever portion; and a switch driving lever that is capable of rotating the arm, wherein the switch driving lever comprises:

a rotating shaft portion;

a first lever portion that extends from the rotating shaft portion toward the output plate and is rotatable according to the output plate;

an arm contact surface portion that contacts with the arm to transmit a driving force to the arm so as to rotate the arm to the first position or the second position; and a third lever portion that extends upward from the rotating shaft portion to be restrained by the driving lever latch or released from the driving lever latch.

8. The magnetic trip device of claim 1, further comprising a latch bias spring configured to apply an elastic force to the driving lever latch to rotate in one direction.

9. The magnetic trip device of claim 8, wherein the latch bias spring is configured with a torsion spring.

10. The magnetic trip device of claim 1, further comprising a return spring configured to apply an elastic force to the output plate to return to an initial position.

11. The magnetic trip device of claim 10, wherein an elastic modulus of the return spring is larger than an elastic modulus of the driving lever bias spring.

* * * * *